US005937251A

United States Patent [19]

Suzuki

[11] Patent Number: 5,937,251

[45] Date of Patent: Aug. 10, 1999

[54] DEVELOPING DEVICE AND IMAGE FORMING APPARATUS

[75] Inventor: Tsuyoshi Suzuki, Nagoya, Japan

[73] Assignee: Brother Kogyo Kabushiki Kaisha, Nagoya, Japan

[21] Appl. No.: 09/028,288

[22] Filed: Feb. 24, 1998

[30] Foreign Application Priority Data

Feb. 27, 1997 [JP] Japan ..... 9-044461

[51] Int. Cl.[6] ..... G03G 15/08; G03G 21/10

[52] U.S. Cl. ..... 399/253; 399/359

[58] Field of Search ..... 399/253, 357–360

[56] References Cited

U.S. PATENT DOCUMENTS 3,700,328 10/1972 Davidge et al. .
3,728,016 4/1973 Harbour et al. .
3,918,808 11/1975 Narita .
4,154,522 5/1979 Ikesue .
4,376,578 3/1983 Tanaka et al. .
4,389,968 6/1983 Satomura .
4,436,413 3/1984 Oka .
4,545,325 10/1985 Komatsu .
4,571,066 2/1986 Morrison .
4,639,115 1/1987 Lin .
4,707,115 11/1987 Bares .
5,153,642 10/1992 Folkins et al. .
5,335,051 8/1994 Tani .
5,455,666 10/1995 Saito et al. .
5,532,800 7/1996 Saito .
5,710,960 1/1998 Hart et al. ..... 399/253
5,734,957 3/1998 Ogawa et al. ..... 399/359

*Primary Examiner*—Richard Moses
*Attorney, Agent, or Firm*—Oliff & Berridge, PLC

[57] ABSTRACT

A developing device is provided with: a photosensitive body; a developing roller for performing an electro-photography on the photosensitive body at a predetermined developing position of the photosensitive body by using charged toners; a moving device for moving the developing roller and the photosensitive body such that the developing roller performs the electro-photography on the photosensitive body at the developing position and that, after the electro-photography is performed, the photosensitive body transports the toners, which have never been used for the electro-photography and remain on the photosensitive body, to the developing position where the transported toners adhere from the photosensitive body onto the developing roller so as to recover the transported toners from the photosensitive body onto the developing roller; and a collecting device opposed to the developing roller for collecting impurities mixed in the recovered toners on the developing roller by contacting with the developing roller.

18 Claims, 5 Drawing Sheets

DEVELOPING DEVICE AND IMAGE FORMING APPARATUS

BACKGROUND OF THE INVENTION

1. Field of the Invention

The present invention relates to a developing device in an image forming apparatus, which forms an image by means of an electro-photography by using electrically charged toners, and especially relates to a developing device capable of re-using the toners by recovering the toners, which have never been used in one cycle of the image formation and have remained on the photosensitive body.

2. Description of the Related Art

There is an image forming apparatus, such as a printer or the like, which forms and records an image onto a record paper by means of a so-called electro-photography by use of a developing device, which is provided with at least a photosensitive drum servicing as a photosensitive body and a developing roller.

For this kind of image forming apparatus, a technique is being developed to recover the toners, which have never been used in one cycle of the image formation and have remained on the photosensitive drum (hereinafter, it is referred to as "remaining toners") and re-use the toners, from a view point of saving the resources.

As one effective method of recovering the remaining toners, there is a method of transporting the remaining toners on the photosensitive drum from the photosensitive drum to the developing roller by use of the rotation of the photosensitive drum itself, so as to recover the remaining toners by the developing roller.

In the image formation by means of the electro-photography, impurities such as fine paper fibers, dusts etc. on the record paper, on which the image is to be formed, often attach onto the photosensitive drum. Thus, the remaining toners in such a condition that the impurities are mixed in the remaining toners are recovered and re-used according to the above mentioned method of recovering the remaining toners, resulting in problems that the inside of the toner box is contaminated by the impurities, the life of the toners is shortened, and that the image cannot be clearly formed when the recovered toners are re-used, due to the impurities.

SUMMARY OF THE INVENTION

The present invention is proposed in view of the above mentioned problems. It is therefore an object of the present invention to provide a developing device and an image forming apparatus having the developing device, which can electrically recover the remaining toners in a high purity condition via the photosensitive drum and the developing roller.

The above object of the present invention can be achieved by a developing device provided with: a photosensitive body; a developing roller for performing an electro-photography on the photosensitive body at a predetermined developing position of the photosensitive body by using charged toners; a moving device for moving the developing roller and the photosensitive body such that the developing roller performs the electro-photography on the photosensitive body at the developing position and that, after the electro-photography is performed, the photosensitive body transports the toners, which have never been used for the electro-photography and remain on the photosensitive body, to the developing position where the transported toners adhere from the photosensitive body onto the developing roller so as to recover the transported toners from the photosensitive body onto the developing roller; and a collecting device opposed to the developing roller for collecting impurities mixed in the recovered toners on the developing roller by contacting with the developing roller.

According to the developing device of the present invention, the electro-photography is performed on the photosensitive body at the developing position by the developing roller, by using charged toners while the developing roller and the photosensitive body are moved by the moving device. Then, after the electro-photography is performed, the photosensitive body is moved, so that the photosensitive body transports the remaining toners, which have never been used for the electrophotography and remain on the photosensitive body, to the developing position. Then, the transported toners adhere from the photosensitive body onto the developing roller. Thus, the transported toners can be recovered from the photosensitive body onto the developing roller. At this time, the impurities such as the paper fibers, the dusts etc., mixed in the recovered toners on the developing roller are collected by the collecting device, which contacts with the developing roller.

Thus, since the impurities can be removed from the recovered toners, it becomes possible to re-use the recovered toners in a high purity condition. Therefore, it is possible to clearly develop the image by use of the toners in the high purity condition, and it is also possible to extend the life of the toners which are repeatedly recovered as well as the life of the developing device itself.

In one aspect of the developing device, the collecting device comprises a non-woven fabric cloth for collecting the impurities by contacting with the developing roller in a forward direction with respect to a rotation direction of the developing roller.

According to this aspect, since the impurities are collected by the non-woven fabric cloth, which contacts with the developing roller in the forward direction, it is possible to easily remove the impurities from the recovered toners by use of a relatively simple configuration with a low cost.

In another aspect of the developing device, the collecting device comprises a brush for collecting the impurities by contacting with the developing roller in a forward direction with respect to a rotation direction of the developing roller.

According to this aspect, since the impurities are collected by the brush, which contacts with the developing roller in the forward direction, it is possible to easily and surely remove the impurities from the recovered toners by use of a relatively simple configuration.

In another aspect of the developing device, the collecting device separates the collected impurities from the recovered toners on the developing roller so that the developing roller re-uses the recovered toners without the impurities.

According to this aspect, since the collected impurities are separated from the recovered toners by the collecting device, the recovered toners without the impurities are re-used by the developing roller. Thus, it is possible to efficiently re-use the recovered toners in the high purity condition.

In another aspect of the developing device, the collecting device contacts with the developing roller at a downstream side of the developing position in a rotation direction of the developing roller.

According to this aspect, at the downstream side of the developing position, the collecting device contacts with the developing roller. Thus, the collecting device can certainly collect the remaining toners which have passed through the developing position on the photosensitive body.

In another aspect of the developing device, the developing device is further provided with a seal member for scraping the recovered toners on the developing roller, wherein the collecting device contacts with the developing roller at an upstream side of the seal member in a rotation direction of the developing roller.

According to this aspect, on the developing roller, at first the impurities included in the recovered toners are collected by the collecting device at the upstream side of the seal member. After that, the toners on the developing roller are scraped by the seal member. Thus, the scraped toners can be re-used as the toners in the high purity condition.

In another aspect of the developing device, the developing device is further provided with an absorbing device for electrically absorbing the toners, which have never been used for the electro-photography and remain on the photosensitive body, from the photosensitive body by contacting with the photosensitive body, wherein, after the electro-photography is performed, the photosensitive body electrically absorbs the toners, which have been once absorbed on the absorbing device, from the absorbing device and transports the absorbed toners to the developing position where the transported toners are electrically transported from the photosensitive body onto the developing roller.

According to this aspect, after the electro-photography is performed, the remaining toners, which have never been used for the electro-photography and remain on the photosensitive body, are electrically absorbed from the photosensitive body by the absorbing device, which contacts with the photosensitive body. After that, the toners, which have been once absorbed on the absorbing device, are electrically absorbed from the absorbing device onto the photosensitive body. Then, the absorbed toners are transported to the developing position, and finally, the transported toners are electrically transported from the photosensitive body onto the developing roller.

Thus, it is possible to reliably recover the remaining toners.

In this aspect, the absorbing device may comprise a roller for electrically absorbing the toners from the photosensitive body. Thus, by use of a relatively simple configuration, the toners can be electrically absorbed by the absorbing device.

In this aspect also, the developing device may be further provided with another collecting device opposed to the absorbing device for collecting the impurities mixed in the absorbed toners on the absorbing device by contacting with the absorbing device. Accordingly, the impurities in the toners, which have returned from the absorbing device onto the photosensitive body can be diminished by this another collecting device, so that the efficiency of removing the impurities out of the recovered toners can be further promoted.

In another aspect of the developing device, the developing device is further provided with a process unit having a developing chamber in which the developing roller is disposed and in which the toners supplied from a toner storage and the toners recovered from the photosensitive body are tentatively accommodated.

According to this aspect, the toners supplied from the toner storage and the toners recovered from the photosensitive body are tentatively accommodated in the developing chamber. Thus, the recovered toners can be efficiently re-used together with the toners supplied from the toner storage.

The above object of the present invention can be also achieved by an image forming apparatus provided with: the above described developing device of the present invention in various aspects; a latent image forming device for forming on the photosensitive body an electro-static latent image corresponding to an image to be recorded; a transferring device for transferring the toners, which are adhered to the photosensitive body in correspondence with the formed electro-static latent image, onto a record paper on which the image is to be recorded; and a fixing device for fixing the toners transferred on the record paper.

According to the image forming apparatus of the present invention, the electro-static latent image is formed on the photosensitive body by the latent image forming device. Then, the electro-photography is performed by the developing device in the above described manner. Then, the toners, which are adhered to the photosensitive body in correspondence with the formed electro-static latent image, are transferred onto the record paper by the transferring device. Finally, the toners are fixed on the record paper by the fixing device.

Thus, since the impurities can be removed from the recovered toners, it becomes possible to re-use the recovered toners in a high purity condition. Therefore, it is possible to clearly develop the image by use of the toners in the high purity condition and thereby form a clear image, and it is also possible to extend the life of the toners which are repeatedly recovered as well as the life of the developing device itself.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENT

A preferred embodiment for the present invention is explained with reference to the drawings. The embodiment described below is an embodiment in which the present invention is applied to a so-called laser printer for performing a development by means of the non-magnetic material of single component.

(I) Whole Configuration and Operation

At first, the whole configuration of a laser printer according to the embodiment is explained with reference to FIGS. 1 and 2. Incidentally, FIG. 1 is a perspective view showing the appearance of the laser printer according to the embodiment, and FIG. 2 is a vertical longitudinal section view at the central portion thereof.

Figure 1:
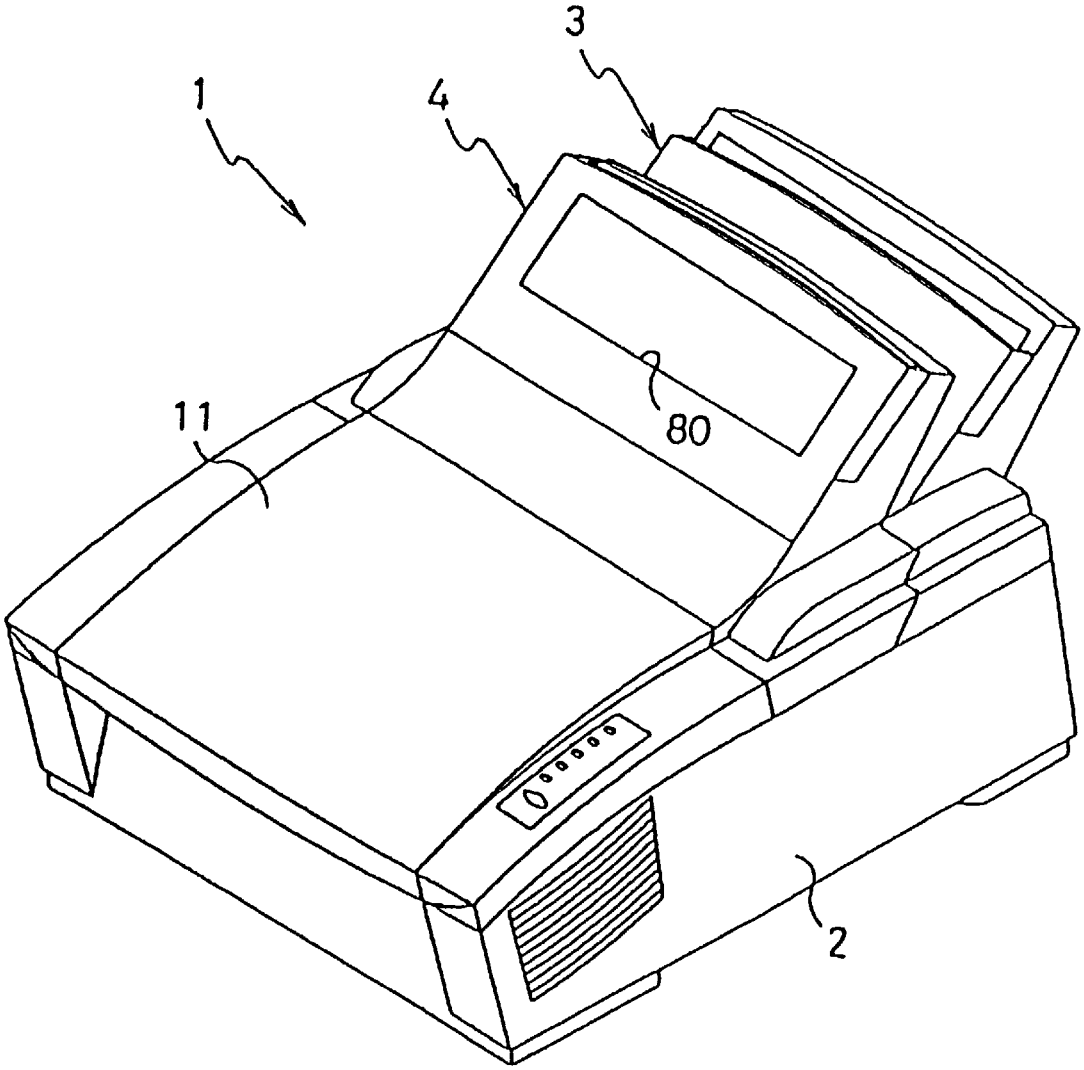
FIG. 1 is a perspective view showing an appearance of a laser printer of an embodiment.
Figure 2:
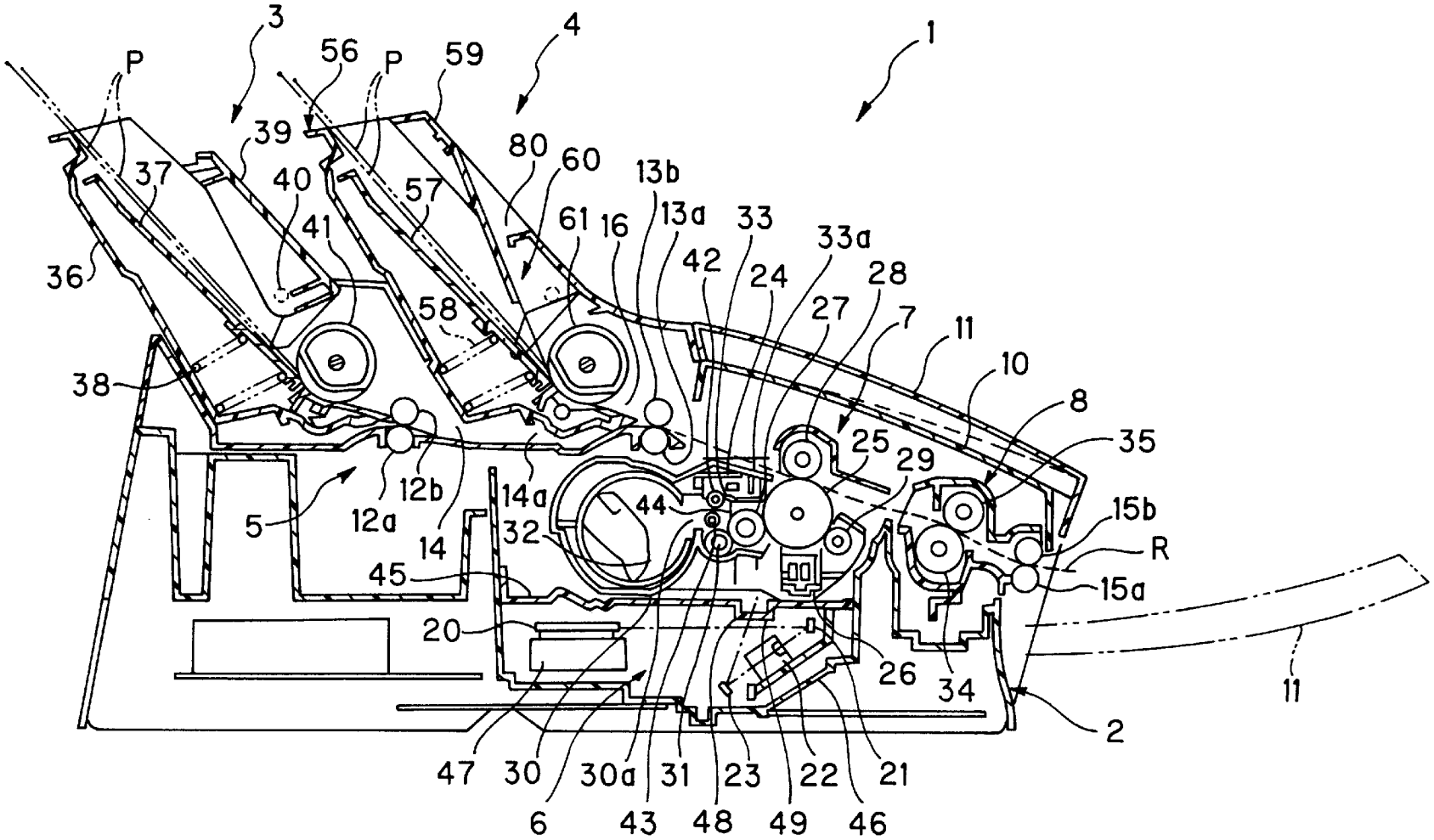
FIG. 2 is a vertical longitudinal section view showing a configuration of the laser printer of the embodiment.

As shown in FIGS. 1 and 2, a laser printer 1 of the embodiment is provided with: a main body case 2; a first paper transporting tray unit 3 and a second paper transporting tray unit 4 which are disposed on the top surface of the rear of the main body case 2; a paper transporting mechanism 5 disposed within the main body case 2; a scanner unit 6 servicing as one example of an latent image forming device; a process unit 7; a fixing unit 8 servicing as one example of a fixing device; and a driving unit (not shown) accommodated in the left end side on the front surface of the main body case 2 to drive the first paper transporting tray unit 3, the second paper transporting tray unit 4, the paper transporting mechanism 5, the process unit 7, the fixing unit 8 and the like.

A top cover 10, by which the inside of the laser printer 1 can be opened, and a paper discharging tray 11 are disposed on the top surface of the front portion of the main body case 2. Among them, the paper discharging tray 11 can be switched from a close position shown by solid line to an open position shown by a chain line in FIG. 2. When the paper discharging tray 11 is located at the open position, it services as the tray of receiving and accumulating the recorded papers.

In the above mentioned configuration, the scanner unit 6, the process unit 7 and the fixing unit 8 constitutes the print mechanism for actually performing the recording operation.

Among them, the process unit 7 has a cartridge structure in such a way that it contains a photosensitive drum 25, a charger 26, a developing roller 27, a transferring roller 28 servicing as one example of a transferring device, a cleaning roller 29 servicing as one example of a absorbing roller and the like within a casing 24 and that the process unit 7 can be mounted on and dismounted from a predetermined portion within the main body case 2.

Moreover, the first paper transporting tray unit 3 is fixedly disposed on the top surface in the vicinity of the back end of the main body case 2. The second paper transporting tray unit 4 is detachably disposed on the top surface of the front portion of the first paper transporting tray unit 3 in the main body case 2.

On the other hand, the paper transporting mechanism 5 transports paper P alternatively transported from the first paper transporting tray unit 3 and the second paper transporting tray unit 4 to the process unit 7, and is provided with a pair of transporting rollers 12*a* and 12*b* disposed on the lower end side of the first paper transporting tray unit 3, and a pair of resist rollers 13*a* and 13*b* disposed on the front portion at the lower end of the second paper transporting tray unit 4. Among them, the transporting roller 12*a* is a driving roller, and the transporting roller 12*b* is a driven roller. Further, the resist roller 13*a* is a driving roller, and the resist roller 13*b* is a driven roller.

A paper transporting path 14 from the first paper transporting tray unit 3 to the resist rollers 13*a* and 13*b* includes a bottom side transporting path 14*a* extending along the bottom surface of the second paper transporting tray unit 4. Then, the bottom side transporting path 14*a* becomes in an externally-opened state in the condition that the second paper transporting tray unit 4 is removed from the main body case 2.

Moreover, the paper P transported from the first paper transporting tray unit 3 is transported by the transporting rollers 12*a* and 12*b*, passed on the bottom side transporting path 14*a*, and arrives at the resist rollers 13*a* and 13*b*. After the resist, the paper P is transported to the process unit 7.

On the other hand, the paper P transported from the second paper transporting tray unit 4 arrives at the resist rollers 13*a* and 13*b*. After the resist, the paper P is transported to the process unit 7.

Next, as for the first paper transporting tray unit 3 in detail, the first paper transporting tray unit 3 is provided with: a tray case 36 which can accommodate a plurality of papers P in a backward-raised and inclined state; a paper receiving plate 37 which is disposed at the bottom of the tray case 36 and receives the bottom side of the papers P; a compressed coil spring 38 for forward pushing the paper receiving plate 37; a tray cover 39 which is located opposite to the front side of the paper receiving plate 37 and rotatably disposed in the vicinity of the lower end of the tray case 36 and can be opened and closed by a predetermined angle; a releasing mechanism 40 for releasing the paper receiving plate 37, which functions in conjunction with the opening action of the tray cover 39, backward against the force of the compressed coil spring 38; a paper transporting roller 41; and so on.

Moreover, the second paper transporting tray unit 4 is provided with: a tray case 56 which can accommodate a plurality of papers P in a backward-raised and inclined state; a paper receiving plate 57 which is disposed at the bottom of the tray case 56 and receives the bottom side of the papers P; a compressed coil spring 58 for forward pushing the paper receiving plate 57; a tray cover 59 which is located opposite to the front side of the paper receiving plate 57 and rotatably disposed in the vicinity of the lower end of the tray case 56 and can be opened and closed by a predetermined angle; a releasing mechanism 60 for releasing the paper receiving plate 57, which functions in conjunction with the opening action of the tray cover 59, backward against the force of the compressed coil spring 58; a paper transporting roller 61; and so on. Incidentally, a manually inserting paper port 80 for transporting the paper P by hand is disposed on the front surface of the second paper transporting tray unit 4.

Next, the process unit 7 is actually explained. The process unit 7 is a unit for performing a toner development for a latent image by supplying the toners to an electro-static latent image formed on the surface of the photosensitive drum 25, on the basis of image data to be recorded by a laser optical system which is disposed in the scanner unit 6 and described later.

That is, the process unit 7 is provided with: the photosensitive drum 25; the transferring roller 28 in contact with the top surface of the photosensitive drum 25; the SCOROTORON type charger 26 disposed below the photosensitive drum 25; the developing device having the developing roller 27 disposed upstream from the photosensitive drum 25 in the paper transport direction and a toner supplying roller 31; a detachable toner cartridge 30 servicing as one example of a toner retainer disposed further upstream therefrom; the cleaning roller 29 disposed downstream from the photosensitive drum 25 in the paper transport direction; and so on.

A pair of upper and lower augers 42 and 43 are rotatably disposed above the toner supplying roller 31 within the developing chamber in the developing device (hereafter, this "developing chamber" implies the portions including the toner supplying roller 31, the developing roller 27, the upper auger 42, the lower auger 43 described later and the like). The lower auger 43 has a function of carrying the toner, which is supplied into the developing chamber through a toner supply port 30*a* (e.g., a hole formed on a substantial center of the toner cartridge 30 and a hole formed on the casing 24) from the toner cartridge 30, in both end directions of the toner supplying roller 31 above it. The upper auger 42 has a function of carrying the toner from both end sides of the toner supplying roller 31 toward the toner supply port 30*a*. In this way, the toners, which are supplied to the developing chamber side from the toner supply port 30*a* through the lower auger 43 and the upper auger 42, are carried and circulated above the toner supplying roller 31 in both end directions thereof. The toners are supplied while adhered to the toner supplying roller 31 during the carrying and circulating operations. In this embodiment, in order to promote the function of the upper auger 42, an auger partition plate 44 is arranged in a direction parallel to rotational axes of the respective upper auger 42 and lower auger 43 between these upper and lower augers 42 and 43.

On the other hand, a blade 33 is fixed by an L-shaped plate fixing member 33*a* on the bottom surface of the casing 24 above the developing roller 27. This blade 33 charges the toners, which are supplied to the developing roller 27 from the toner supplying roller 31, with a predetermined polarity, and further regulates the layer thickness of a toner layer to a predetermined thickness.

Moreover, an electro-static latent image corresponding to the image data to be recorded by scanning and emitting a laser beam from the scanner unit 6 to the layer charged by the charger 26 is formed on the outer circumference of the photosensitive drum 25. At this time, the toners within the toner cartridge 30 are agitated by an agitator 32 and then exhausted from the toner supply port 30*a*. After that, it is supported on the outer circumference surface of the developing roller 27 through the toner supplying roller 31. Thus, the thickness of the toner layer is regulated by the blade 33. Accordingly, the electro-static latent image formed on the photosensitive drum 25 is actualized by the adhesion of the toners by the developing roller 27, and is then transferred onto a paper P passed between the transferring roller 28 and the photosensitive drum 25. After that, the toners remaining on the photosensitive drum 25 are once electrically kept on the cleaning roller 29. Then, they are electrically returned onto the photosensitive drum 25 at a predetermined timing at which an image is not recorded on the paper P (for example, between a carried paper P and a next paper P, and the like). Furthermore, it is supported on the developing roller 27 and collected into the developing chamber.

Next, the scanner unit 6 is explained.

As shown in FIG. 2, the scanner unit 6 comprises a known laser optical system. This is a unit for performing a scanning operation of the laser optical system on the basis of the inputted image data to be recorded to thereby form the electro-static latent image on the surface of the photosensitive drum 25.

More concretely, the scanner unit 6 is disposed below the process unit 7. A scanner cover 45 is disposed on the top surface of the scanner unit 6. This scanner cover 45 is fixed such that it covers the substantially entire opening on the upstream side in the paper transport direction of a bottom plate 46 of the main body case 2. The scanner unit 6 servicing as one example of an exposing unit is constructed such that a laser emitting section (not shown) such as a semiconductor laser and the like, a scanner motor 47, a polygon mirror 20, a lens 22, reflection mirrors 21 and 23, and so on are disposed on the bottom side of the scanner cover 45. The laser light is passed through a glass plate 49 fitted into an oblong scanner hole 48 formed so as to extend along the rotational axis line of the photosensitive drum 25 by the scanner cover 45, and is emitted onto the outer circumference surface of the photosensitive drum 25. Accordingly, the electro-static latent image is exposure-formed on the outer circumference surface of the photosensitive drum 25 on the basis of the image data. As mentioned above, the toners are supplied through the process unit 7 to the electro-static latent image formed on the photosensitive drum 25 by the laser optical system of the scanner unit 6. Accordingly, the toner development is performed for the electro-static latent image.

Next, the toner image corresponding to the electro-static latent image formed on the photosensitive drum 25 within the process unit 7 is transferred onto the paper P transported to the process unit 7, and is then transported to the fixing unit 8. This fixing unit 8 fixes the toners, which have been transferred onto the paper P, on the paper P by heating. The fixing unit 8 is provided with: a heating roller 34; a pushing roller 35 pushed against the heating roller 34; and a pair of discharging rollers 15*a* and 15*b*, which are disposed downstream from the heating roller 34 and the pushing roller 35, for discharging the paper P outside the main body case 2.

In FIG. 2, a route R of the paper P between the resist rollers 13*a*, 13*b* and the paper discharging tray 11 disposed downstream in the paper transport direction is indicated by a dotted line.

(II) Detailed Configuration and Function of Process Unit

Figure 3:
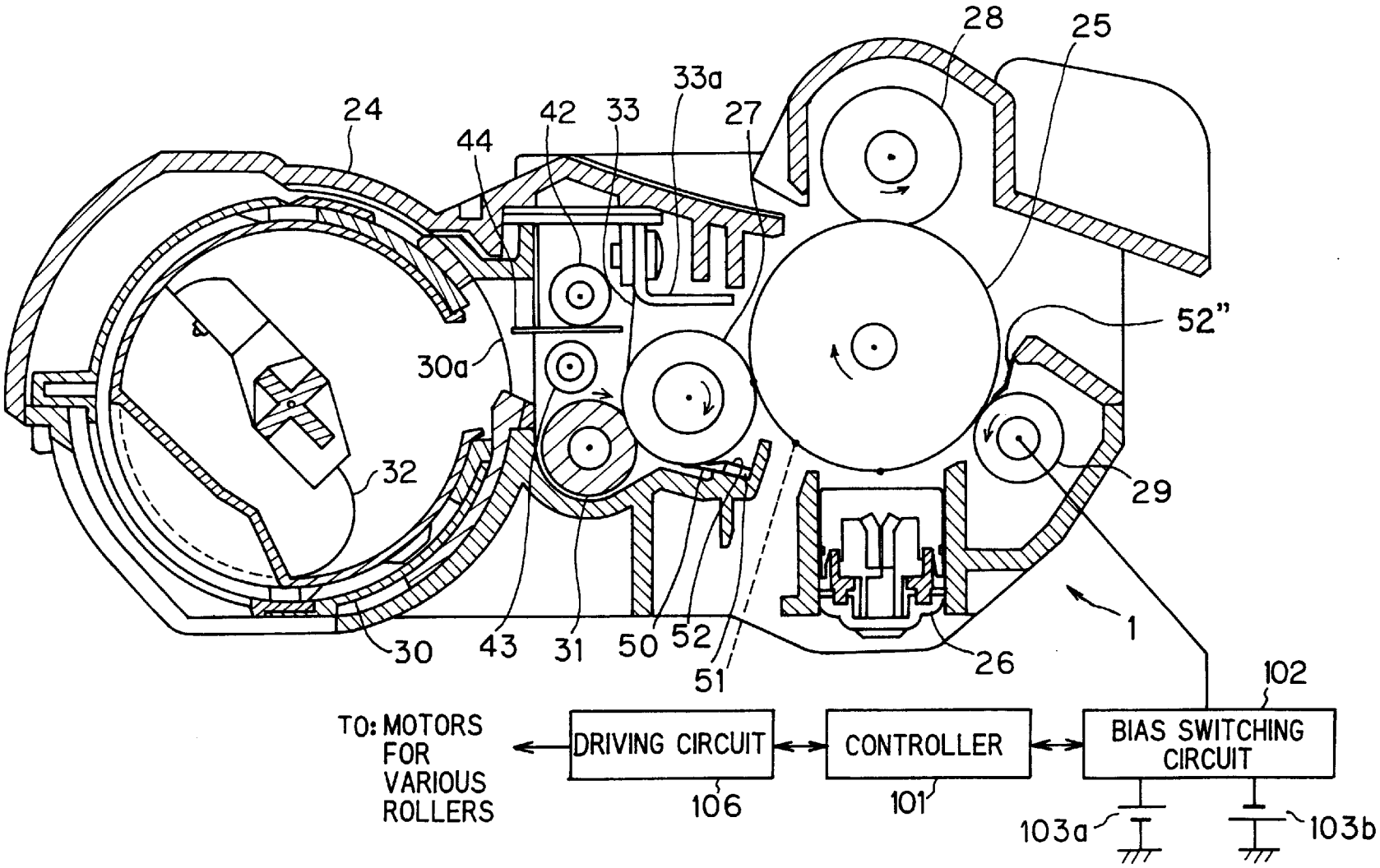
FIG. 3 is a vertical longitudinal section view showing a configuration of a process unit in the laser printer of the embodiment.
Figure 4:
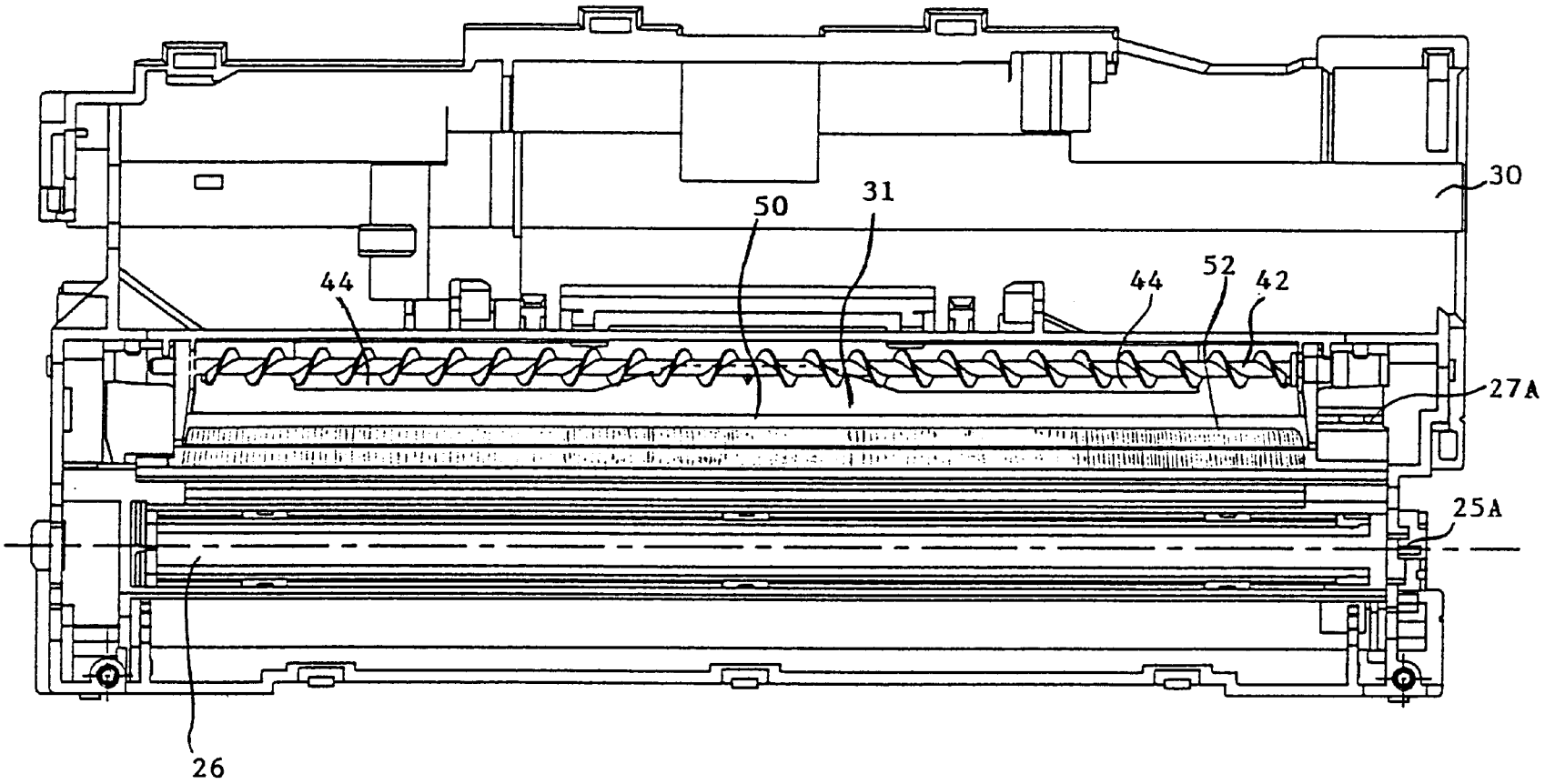
FIG. 4 is a plan view showing a structure of one portion of the process unit of FIG. 3.
Figure 5A:
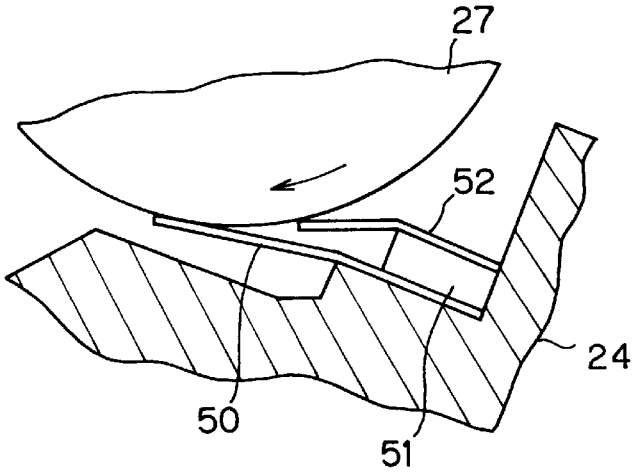
FIG. 5A is an enlarged section view of a seal of the embodiment in a condition that the seal is installed in the laser printer.
Figure 5B:
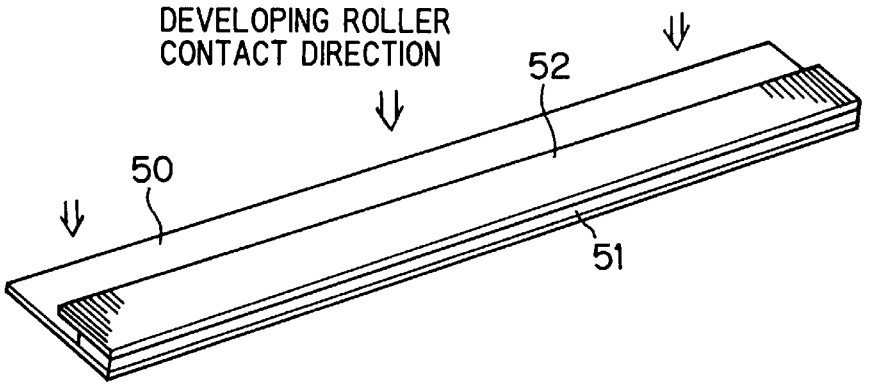
FIG. 5B is a perspective view showing an appearance of the seal of the embodiment.

The detailed configuration of the process unit 7 according to the present invention is explained with reference to FIGS.3 to 5B. Incidentally, FIG. 3 is an enlarged vertical longitudinal section view of the process unit 7, FIG. 4 is a plan view of the process unit 7, in which the upper half portion of the casing 24 is removed and the photosensitive drum 25 and the developing roller 27 are further removed, FIG. 5A is an enlarged section view of a seal of the embodiment described later in detail, and FIG. 5B is a perspective view of the seal.

The developing operation performed by the process unit 7 of the embodiment is the inversion developing operation by means of the so-called impression developing method using the toners comprising the non-magnetic material of one component.

As mentioned above, when forming the image, the toners are discharged from the toner supply port 30*a* of the toner cartridge 30 while the toners are agitated by the agitator 32, are substantially uniformly divided in the direction of the central axis on the toner supplying roller 31 by the actions of the lower auger 43 and the upper auger 42 and the auger partition plate 44, and are then supplied to the developing roller 27 made of an elastic rubber roller. At this time, the toner supplying roller 31 and the developing roller 27 are rotated in the directions opposite to each other. Moreover, while the contact with the blade 33 causes the toners to be electrically charged, the charged toners are supplied to the developing roller 27.

Next, the toners supplied onto the developing roller 27 are adhered to the photosensitive drum 25. At this time, there is the electro-static latent image, which corresponds to the image data and is formed by the laser light scanning the outer circumference surface of the photosensitive drum 25 charged by the charger 26 (i.e., the electro-static latent image formed by the potential reduction relative to the portion to which the laser light is emitted, with respect to the potential of the photosensitive drum 25 when charged with a predetermined level by the charger 26), on the photosensitive drum 25. Then, the electro-static latent image is actualized by the electrical adhesion of the toners charged with the predetermined polarity to the portion of the electro-static latent image (this toner is charged with the same polarity as the potential of the electro-static latent image by the friction between the toner supplying roller 31 and the developing roller 27).

The image actualized by the adhesion of the toner to the photosensitive drum 25 is transferred onto the paper P transported by the transferring roller 28. After that, the paper P is transported to the fixing unit 8.

Next, the remaining toners on the photosensitive drum 25 are electrically absorbed and tentatively supported by the cleaning roller 29. Then, at the timing when the paper P is not transported, the remaining toners absorbed and supported by the cleaning roller 29 are returned onto the photosensitive drum 25 by applying an electric field between the photosensitive drum 25 and the cleaning roller 29, which direction is reverse to that applied when the remaining toners are absorbed by the cleaning roller 29.

More concretely, as shown in FIG. 3, the laser printer of the present embodiment is provided with a controller 101, a bias switching circuit 102, a positive electric voltage source 103*a*, a negative electric voltage source 103*b*, and a driving circuit 106. The controller 101 is adapted to control the switching operation of the bias switching circuit 102, which selectively connects one of the positive and negative electric voltage sources 103*a* and 103*b*, and the driving operation of the driving circuit 106, which supplies driving signals to motors for various rollers so as to rotate the photosensitive drum 25, the developing roller 27 and so on in a predetermined manner. When the cleaning roller 29 is to electrically absorb the remaining toners from the photosensitive drum 25, under the control of the controller 101, the bias switching circuit 102 switches so that one of the positive and negative electric voltage sources 103*a* and 103*b* is connected to the cleaning roller 29. On the other hand, when the photosensitive drum 25 is to electrically absorb the toners, which have been tentatively absorbed on the cleaning roller 29, under the control of the controller 101, the bias switching circuit 102 switches so that the other of the positive and negative electric voltage sour is connected to this connected to the cleaning roller 29, to invert the electric field between the photosensitive drum 25 and the cleaning roller 29.

In the present embodiment, a cleaner 52", which has a construction same as the cleaner 52, is disposed at an upper stream side in the rotation direction of the photosensitive drum 25 with respect to the position where the photosensitive drum 25 and the cleaning roller 29 are opposed to each other. By the cleaner 52", the impurities in the toners, which have returned from the cleaning roller 29 onto the photosensitive drum 25 can be diminished. Thus, by virtue of the cleaner 52" in addition to the cleaner 52, the efficiency of removing the impurities out of the recovered toners can be further: promoted. Off course, by employing such a construction that only one of the cleaners 52 and 52" is equipped in the present embodiment, it is still possible to remove the impurities out of the recovered toners to some extent, so that the present embodiment has a certain advantage over the conventional image forming apparatus in which none of the cleaners 52 and 52" is equipped.

Then, the remaining toners supported on the photosensitive drum 25 are carried to the developing roller 27 as they are, and are collected into the developing chamber by the developing roller 27 to be re-used.

The formation of the image is consecutively performed by the repetition of the above mentioned operations.

In this embodiment, the reason why the cleaning roller 29 is disposed to tentatively collect the remaining toners is that the photosensitive drum 25 is repeatedly rotated to be consecutively used when recording an image on the sheet of paper P. If the remaining toners adhered to the photosensitive drum 25 are collected by the developing roller 27 as they are, the laser light is interrupted at the portion of the remaining toners. As a result, the image to be recorded on one portion of the paper P remains as an afterimage on a subsequent portion of the paper P.

The process unit 7 of the embodiment has a seal 50, in addition to the above mentioned configuration, as shown in FIG. 3, in such a way that, in order to prevent the toners once collected into the developing chamber from leaking out from the developing chamber, the toners become in contact with the developing roller 27 in the forward direction of the rotation thereof (i.e., the direction in which the contact direction and the rotational direction of the developing roller 27 are identical to each other). The seal 50 is fixed at a base edge portion thereof in the lower half of the casing 24 through a board 51. As shown in FIGS. 3, 5A and 5B, a cleaner 52 as one example of a separating device is disposed at a near side of a position where the tip portion of the seal 50 contacts with the developing roller 27 (i.e. at an upstream side in the direction of transporting the remaining toners), on an upper edge surface of the board 51. In FIG. 4, the developing roller 27 is disposed on a roller bearing 27A, and the photosensitive drum 25 is disposed on a drum bearing 25A.

The seal 50 is explained in more detail with reference to FIGS. 5A and 5B. Namely, as shown in FIG. 5A, the seal 50 is disposed such that the tip portion thereof is in contact with the developing roller 27. The seal 50 is made of PET (poly-ethylene terephthalate) material and the like under an extremely uniform condition. Thus, due to the seal 50, there is no or little possibility that the remaining toners adhered to the developing roller 27 from the photosensitive drum 25 are cut off due to the seal 50 and are not collected. This seal 50 prevents the remaining toners collected into the developing chamber from leaking out.

In addition, the cleaner 52 disposed at the upstream of the seal 50 is made of, for example, a non-woven fabric cloth (which is shaped in a cloth by adhering single fibers by use of the adhesion, or by directly bonding them by use of the heat in case of the synthetic fibers), a felt (which is entangled by heating wool or animal hears as a raw material in a slightly alkaline liquid, and compressing it while rubbing) and the like, which has an appropriate flexibility. The cleaner 52 has a function of collecting and separating the impurities such as the fibers of the paper P, the dusts and the like included in the remaining toners, which are recovered via the photosensitive drum 25 and the developing roller 27, from the remaining toners. The cleaner 52 is not formed as far as the tip portion of the seal 50, and slightly contacts with the developing roller 27 by the elastic force of the cleaner 52 itself as shown in FIGS. 5A and 5B.

Here, the reason why only the impurities can be separated by the cleaner 52 in the present embodiment is as following. Namely, when the remaining toners are adhered onto the developing roller 27 from the photosensitive drum 25, the remaining toners are electrically adhered (by the electrostatic force) on the developing roller 27. In contrast to this, the impurities are just adhered on the developing roller 27 at a very small contact area, while the impurities are often or almost always larger than the particles of the remaining toners. Thus, as the cleaner 52 slightly contacts with and follows the surface of the developing roller 27, only the impurities are collected on the cleaner 52, so that the impurities are separated from the remaining toners.

As described above in detail, according to the process unit 7 provided with the seal 50 including the cleaner 52 of the embodiment, the impurities such as the paper fibers, the dusts etc., can be separated and removed from the remaining toners, which have been collected. Thus, it is possible to recover and re-use the remaining toners in a high purity condition.

Further, since the cleaner 52 is the non-woven fabric cloth for collecting the impurities by contacting the developing roller 27 in the forward direction with respect to the rotating direction of the developing roller 27, it is possible to easily and certainly separate the impurities with a low cost.

Furthermore, since the remaining toners, which can be recovered and re-used, are in the high purity condition, it is possible to consecutively record clear images.

As the material of the cleaner 52, as long as it can separate the fibers, the dusts etc. by hooking them from the remaining toners, a felt cloth, a leather or skin in a fiber state or the like other than the non-woven fabric cloth can be employed. In this case, a material as uniform as possible in a fiber state is preferred. The shape of the cleaner 52 is not limited to the sheet shape. For example, the cleaner 52 may have a brush shape and contact with the developing roller 27 with an appropriate flexibility, as shown in FIG. 6.

Figure 6:
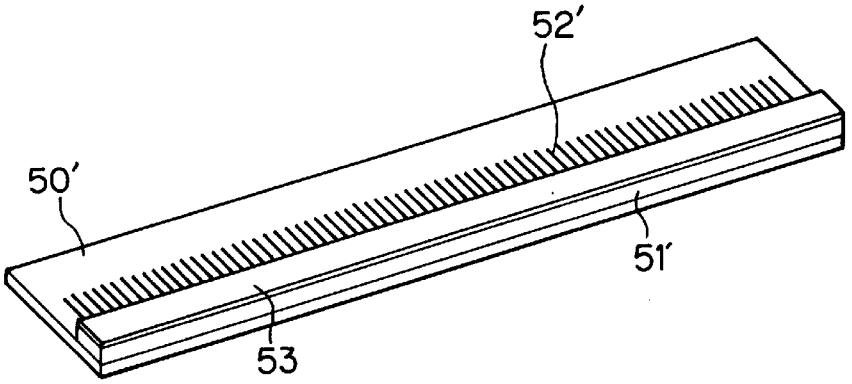
FIG. 6 is a perspective view showing an appearance of the seal of an modified embodiment.

In FIG. 6, as a modified embodiment, the cleaner has a brush 52' comprising acrylic fibers, rayon fibers or the like, which thickness is 3 deniers to 10 deniers (1 denier =9000 m/g), fixed on a board 51' of a seal 50'. The root of the brush 52' may be adhered by the adhesive layer between a tape 53 and the board 51'. Alternatively, the root of the brush 52' may be just adhered by the adhesive or may be welded on the board 51'.

Further, it is possible to charge the cleaner 52 itself, so as to separate the impurities by use of the electro-static force in addition.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A developing device comprising:

a photosensitive body;

a developing roller for developing an electro-static latent image on said photosensitive body at a predetermined developing position by using charged toners;

a moving device for moving said developing roller and said photosensitive body such that, after said developing roller develops the electro-static latent image at the developing position, said photosensitive body transports the toners, which have never been used for developing the electro-static latent image and remain on said photosensitive body, to the developing roller position where the transported toners adhere from said photosensitive body onto said developing roller so as to recover transported toners from said photosensitive body onto said developing roller;

a collecting device opposed to said developing roller for collecting impurities mixed in the recovered toners on said developing roller by contacting with said developing roller by an elastic force at a downstream side of the developing position in a rotation direction of said developing roller;

a toner supplying device for supplying the toners onto said developing roller at a downstream side of said collecting device in the rotation direction; and a blade member opposed to said developing roller for charging the toners on said developing roller and regulating a thickness of the toners on said developing roller at a downstream side of said toner supplying device in the rotation direction prior to the developing position.

2. A developing device according to claim 1, wherein said collecting device comprises a non-woven fabric cloth for collecting the impurities by contacting with said developing roller in a forward direction with respect to the rotation direction .

3. A developing device according to claim 1, wherein said collecting device comprises a brush for collecting the impurities by contacting with said developing roller in a forward direction with respect to the rotation direction.

4. A developing device according to claim 1, wherein said collecting device separates the collected impurities from the recovered toners on said developing roller so that said developing roller re-uses the recovered toners without the impurities.

5. A developing device according to claim 1, further comprising a seal member for scraping the recovered toners on said developing roller, wherein said collecting device contacts with said developing roller at an upstream side of said seal member in the rotation direction.

6. A developing device according to claim 1, further comprising an absorbing device for electrically absorbing the toners, which have never been used for developing the electro-static latent image and remain on said photosensitive body, from said photosensitive body by contacting with said photosensitive body, wherein, after said developing roller develops the electro-static latent image, said photosensitive body electrically absorbs the toners, which have been once absorbed on said absorbing device, from said absorbing device and transports the absorbed toners to the developing position where the transported toners are electrically transported from said photosensitive body onto said developing roller.

7. A developing device according to claim 6, wherein said absorbing device comprises a roller for electrically absorbing the toners from said photosensitive body.

8. A developing device according to claim 6, further comprising another collecting device opposed to said absorbing device for collecting the impurities mixed in the absorbed toners on said absorbing device by contacting with said absorbing device.

9. A developing device according to claim 1, further comprising a process unit having a developing chamber in which said developing roller is disposed and in which the toners supplied from a toner storage and the toners recovered from said photosensitive body are tentatively accommodated.

10. An image forming apparatus comprising (a) a developing device comprising:

a photosensitive body;

a developing roller for developing an electro-static latent image on said photosensitive body at a predetermined developing position by using charged toners;

a moving device for moving said developing roller and said photosensitive body such that, after said developing roller develops the electro-static latent image at the developing position, said photosensitive body transports the toners, which have never been used for developing the electro-static latent image and remain on said photosensitive body, to the developing position where the transported toners adhere from said photosensitive body onto said developing roller so as to recover the transported toners from said photosensitive body onto said developing roller;

a collecting device opposed to said developing roller for collecting impurities mixed in the recovered toners on said developing roller by contacting with said developing roller by an elastic force at a downstream side of the developing position in a rotation direction of said developing roller;

a toner supplying device for supplying the toners onto said developing roller at a downstream side of said collecting device in the rotation direction; and a blade member opposed to said developing roller for charging the toners on said developing roller and regulating a thickness of the toners on said developing roller at a downstream side of said toner supplying device in the rotation direction prior to the developing position, (b) a latent image forming device for forming on said photosensitive body an electro-static latent image corresponding to an image to be recorded, (c) a transferring device for transferring the toners, which are adhered to said photosensitive body in correspondence with the formed electro-static latent image, onto a record paper on which the image is to be recorded, and (d) a fixing device for fixing the toners transferred on said record paper.

11. An image forming apparatus according to claim 10, wherein said collecting device comprises a non-woven fabric cloth for collecting the impurities by contacting with said developing roller in a forward direction with respect to the rotation direction.

12. An image forming apparatus according to claim 10, wherein said collecting device comprises a brush for collecting the impurities by contacting with said developing roller in a forward direction with respect to the rotation direction.

13. An image forming apparatus according to claim 10, wherein said collecting device separates the collected impurities for the recovered toners on said developing roller so that said developing roller re-uses the recovered toners without the impurities.

14. An image forming apparatus according to claim 10, further comprising a seal member for scraping the recovered toners on said developing roller, wherein said collecting device contacts with said developing roller at an upstream side of said seal member in the rotation direction.

15. An image forming apparatus according to claim 10, further comprising an absorbing device for electrically absorbing the toners, which have never been used for developing the electro-static latent image and remain on said photosensitive body, from said photosensitive body by contacting with said photosensitive body, wherein, after said developing roller develops the electro-static latent image, said photosensitive body electrically absorbs the toners, which have been once absorbed on said absorbing device, from said absorbing device and transports the absorbed toners to the developing position where the transported toners are electrically transported from said photosensitive body onto said developing roller.

16. An image forming apparatus according to claim 15, wherein said absorbing device comprises a roller for electrically absorbing the toners from said photosensitive body.

17. An image forming apparatus according to claim 15, further comprising another collecting device opposed to said absorbing device for collecting the impurities mixed in the absorbed toners on said absorbing device by contacting with said absorbing device.

18. An image forming apparatus according to claim 10, further comprising a process unit having a developing chamber in which said developing roller is disposed and in which the toners supplied from a toner storage and the toners recovered from said photosensitive body are tentatively accommodated.

* * * * *